US007946575B2

(12) United States Patent
Kim et al.

(10) Patent No.: US 7,946,575 B2
(45) Date of Patent: May 24, 2011

(54) MEDIUM FEEDING UNIT AND IMAGE FORMING APPARATUS HAVING THE SAME

(75) Inventors: Yong-geun Kim, Suwon-si (KR); Sang-baek Kim, Seoul (KR); Hae-seog Jo, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/107,094

(22) Filed: Apr. 22, 2008

(65) Prior Publication Data

US 2009/0097897 A1 Apr. 16, 2009

(30) Foreign Application Priority Data

Oct. 10, 2007 (KR) ..... 10-2007-0102270

(51) Int. Cl.
*B65H 1/00* (2006.01)

(52) U.S. Cl. ..... 271/171

(58) Field of Classification Search ..... 271/171, 271/145

See application file for complete search history.

(56) References Cited

U.S. PATENT DOCUMENTS

| | | | | | |
|---|---|---|---|---|---|
| 1,326,334 | A | * | 12/1919 | Gaffney | 271/167 |
| 1,987,803 | A | * | 1/1935 | Ryan | 271/171 |
| 4,245,831 | A | * | 1/1981 | Michatek | 271/171 |
| 4,570,757 | A | * | 2/1986 | Marzullo | 188/67 |
| 5,611,528 | A | * | 3/1997 | Nakamura et al. | 271/164 |
| 5,655,764 | A | * | 8/1997 | Ota et al. | 271/171 |
| 5,839,047 | A | * | 11/1998 | Hirabayashi et al. | 399/389 |
| 6,669,188 | B1 | * | 12/2003 | Marasco et al. | 271/171 |
| 7,516,956 | B2 | * | 4/2009 | Allwright et al. | 271/171 |
| 7,533,880 | B2 | * | 5/2009 | Kawanishi et al. | 271/171 |
| 7,543,812 | B2 | * | 6/2009 | Underwood et al. | 271/145 |
| 2003/0116907 | A1 | * | 6/2003 | Pearce et al. | 271/145 |
| 2004/0080095 | A1 | * | 4/2004 | Tan et al. | 271/171 |
| 2006/0113723 | A1 | * | 6/2006 | Ito et al. | 271/162 |

FOREIGN PATENT DOCUMENTS

| | | | |
|---|---|---|---|
| JP | 02276728 | * | 11/1990 |
| JP | 02276728 A | * | 11/1990 |
| JP | 04016427 | * | 1/1992 |
| JP | 04016427 A | * | 1/1992 |

* cited by examiner

*Primary Examiner* — Kaitlin S Joerger
*Assistant Examiner* — Patrick Cicchino
(74) *Attorney, Agent, or Firm* — Staas & Halsey LLP

(57) ABSTRACT

A medium feeding unit for use in an image forming apparatus includes: a cassette frame to load a printable medium; a guiding member disposed inside the cassette frame to move in a widthwise direction of the printable medium, and to guide the printable medium; and a stopper disposed rotatably to the cassette frame to regulate movement of the guiding member.

17 Claims, 5 Drawing Sheets

MEDIUM FEEDING UNIT AND IMAGE FORMING APPARATUS HAVING THE SAME

CROSS-REFERENCE TO RELATED APPLICATION

This application claims all benefits accruing under 35 U.S.C. §119 from Korean Patent Application No. 2007-102270, filed on Oct. 10, 2007 in the Korean Intellectual Property Office, the disclosure of which is incorporated herein by reference.

BACKGROUND OF THE INVENTION

1. Field of the Invention

Aspects of the present invention relate to an image forming apparatus having the same, and more particularly, to a medium feeding unit and an image forming apparatus having the same including a guiding configuration aligning a loaded printable medium.

2. Description of the Related Art

An image forming apparatus, such as, a printer, a photocopier, a facsimile machine or a multi-functional product, forms a visible image on a printable medium during a printing operation by means of a developer or ink based on print data applied from a host. Such an image forming apparatus is typically provided with a medium feeding unit to which a plurality of printable media are loaded, and the medium feeding unit supplies the loaded printable medium one by one during a printing operation.

A medium feeding unit for use in an image forming apparatus includes a cassette frame to which a printable medium of various standards is loaded, and at least one guiding member disposed to move in a widthwise direction of the printable medium to support and align opposite ends of the printable medium. As a result, a printable medium of any standard can be loaded to the cassette frame, and the guiding members can support the opposite sides of the printable medium so as to prevent the printable medium from being dispersed, while the printable medium is supplied for a printing operation.

However, among all the standards of a printable medium, there are standards that are similar, such as, for example, standard letter and standard A4, in which the widths of which are very close in size and are difficult to discern with naked eyes. For example, when a guiding member in a cassette frame is set to a position to support a printable medium of the standard letter size, but a printable medium of the standard A4 size is loaded into the cassette frame, most users will fail to discern this distinction. In this situation, the guiding member will fail to secure the opposite ends of the printable medium. Therefore, a gap is created between the printable medium and the guiding member so that the printable medium supplied during a printing operation can slide to the right or to the left during the printing operation. As a result, an image can be partially formed on a right side or a left side of the printable medium.

In addition, in a typical medium feeding unit, there is no configuration to support each outer side against the guiding members. Therefore, the guiding members can move in a direction in which the printable medium is not supported such that a gap can be created between the printable medium and the guiding members.

SUMMARY OF THE INVENTION

Several aspects and example embodiments of the present invention provide a medium feeding unit and an image forming apparatus having the same regulating movement of a guiding member, a supporting position of which varies to correspond to a standard of a loaded printable medium by a simple stopper with a rotating lever.

Additional aspects and/or advantages of the invention will be set forth in part in the description which follows and, in part, will be obvious from the description, or may be learned by practice of the invention.

In accordance with an example embodiment of the present invention, a medium feeding unit of an image forming apparatus is provided with: a cassette frame having an upper plane to load a printable medium; a guiding member disposed on the upper plane inside the cassette frame to move in a widthwise direction of the printable medium, and to guide the printable medium; and a stopper rotatably disposed on the upper plane inside the cassette frame to regulate movement of the guiding member so as to accommodate the printable of different standards.

According to an aspect of the present invention, the stopper may comprise a plurality of regulating portions which are capable of contacting to the guiding member, and distances from a rotation center of the stopper to the regulating portions are different from each other.

According to another aspect of the present invention, the guiding member may move to correspond to the printable medium of a first standard and/or a second standard different therefrom, and the plurality of regulating portions comprise: a first regulating portion which regulates the movement of the guiding member if the printable medium of the first standard is loaded, and a second regulating portion which regulates the movement of the guiding member if the printable medium of the second standard is loaded.

According to an aspect of the present invention, the first regulating portion and the second regulating portion may respectively regulate the movement of the guiding member if the printing medium of standard A4 and/or standard letter is loaded.

According to an aspect of the present invention, the medium feeding unit of the image forming apparatus may further comprise a rotating lever which is coupled to the stopper, and extended, via the upper plane inside the cassette frame so as to rotate the stopper.

According to another aspect of the present invention, the medium feeding unit of the image forming apparatus may further comprise: a coupling hole perforated through the cassette frame so that the rotating lever can be coupled to the cassette frame, and a separation preventing member formed on the cassette frame to prevent the rotating lever from being separated from the cassette frame.

According to yet another aspect of the present invention, the medium feeding unit of the image forming apparatus may further comprise a rotating lever which is coupled to the stopper, and extended, via the upper plane inside the cassette frame so as to rotate the stopper.

According to another aspect of the present invention, the medium feeding unit of the image forming apparatus may further comprise: a coupling hole perforated through the cassette frame so that the rotating lever can be coupled to the cassette frame, and a separation preventing member formed on the cassette frame to prevent the rotating lever from being separated from the cassette frame.

According to another aspect of the present invention, the medium feeding unit of the image forming apparatus may further comprise a rotating lever which is coupled to the stopper, and extended, via the upper plane inside the cassette frame so as to rotate the stopper.

According to another aspect of the present invention, the medium feeding unit of the image forming apparatus may, further comprise: a coupling hole perforated through the upper plane inside the cassette frame so that the rotating lever can be coupled to the cassette frame, and a separation preventing member formed on the cassette frame to prevent the rotating lever from being separated from the cassette frame.

In accordance with another example embodiment of the present invention, an image forming apparatus comprises: an image forming unit which forms an image on a printable medium; and a medium feeding unit which supplies the printable medium to the image forming unit, the medium feeding unit comprising: a cassette frame having an upper plane to load a printing medium; a guiding member disposed on the upper plane inside the cassette frame to move in a widthwise direction of the printable medium, and to guide the printable medium; and a stopper rotatably disposed on the upper plane inside the cassette frame to regulate movement of the guiding member so as to accommodate the printable medium of different standards.

According to an aspect of the present invention, the stopper may comprise a plurality of regulating portions which are capable of contacting to the guiding member, and distances from a rotation center of the stopper to the regulating portions are different from each other.

According to another aspect of the present invention, the image forming apparatus may further comprise a rotating lever which is coupled to the stopper, and extended, via the upper plane inside the cassette frame so as to rotate the stopper.

According to another aspect of the present invention, the image forming apparatus may further comprise: a coupling hole perforated through the upper plane inside the cassette frame so that the rotating lever can be coupled to the cassette frame, and a separation preventing member formed on the cassette frame to prevent the rotating lever from being separated from the cassette frame.

According to another aspect of the present invention, the image forming apparatus may further comprise a rotating lever which is coupled to the stopper, and extended, via the upper plane inside the cassette frame so as to rotate the stopper.

According to another aspect of the present invention, the image forming apparatus may further comprise: a coupling hole perforated through the upper plane inside the cassette frame so that the rotating lever can be coupled to the cassette frame, and a separation preventing member formed on the cassette frame to prevent the rotating lever from being separated from the cassette frame.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
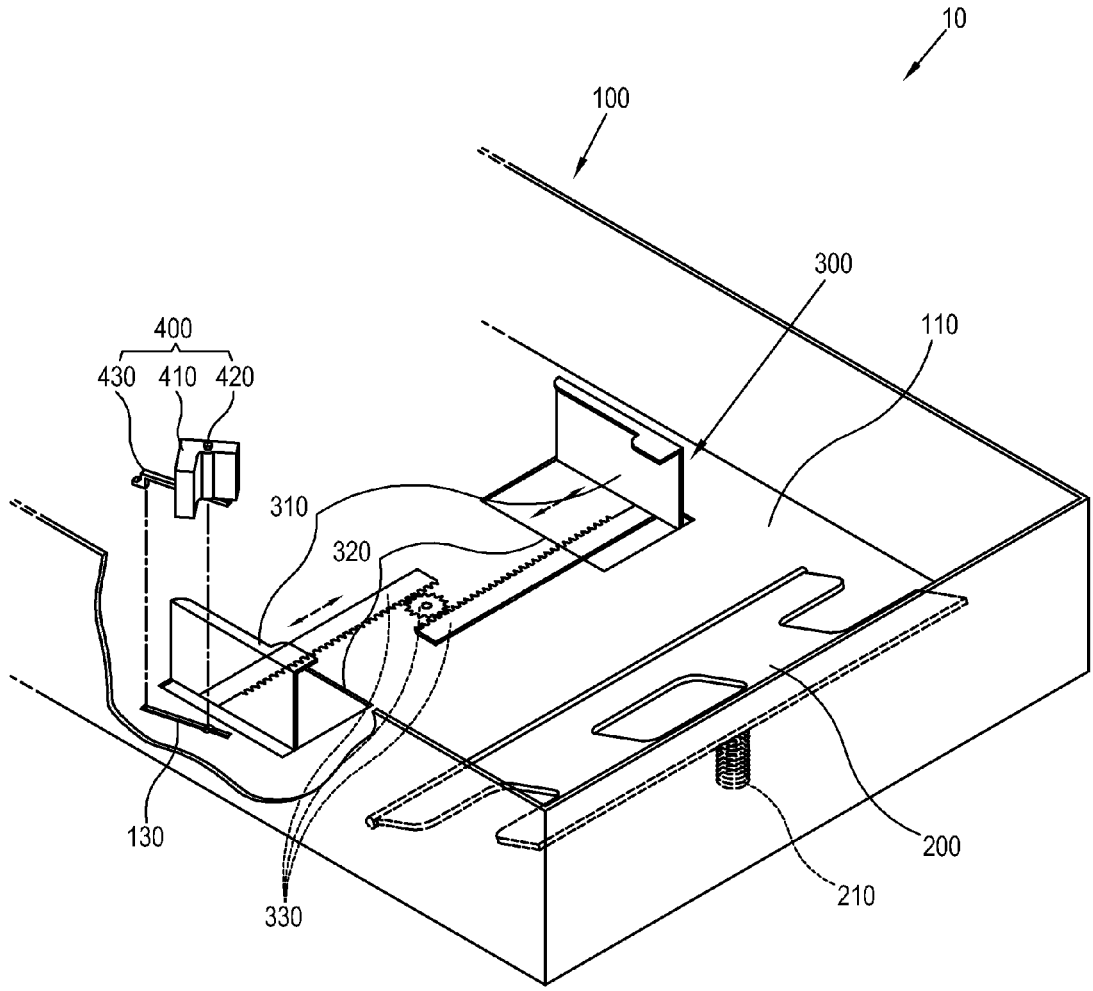
FIG. 1 is an exploded perspective view of a medium feeding unit for use in an image forming apparatus according to an example embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
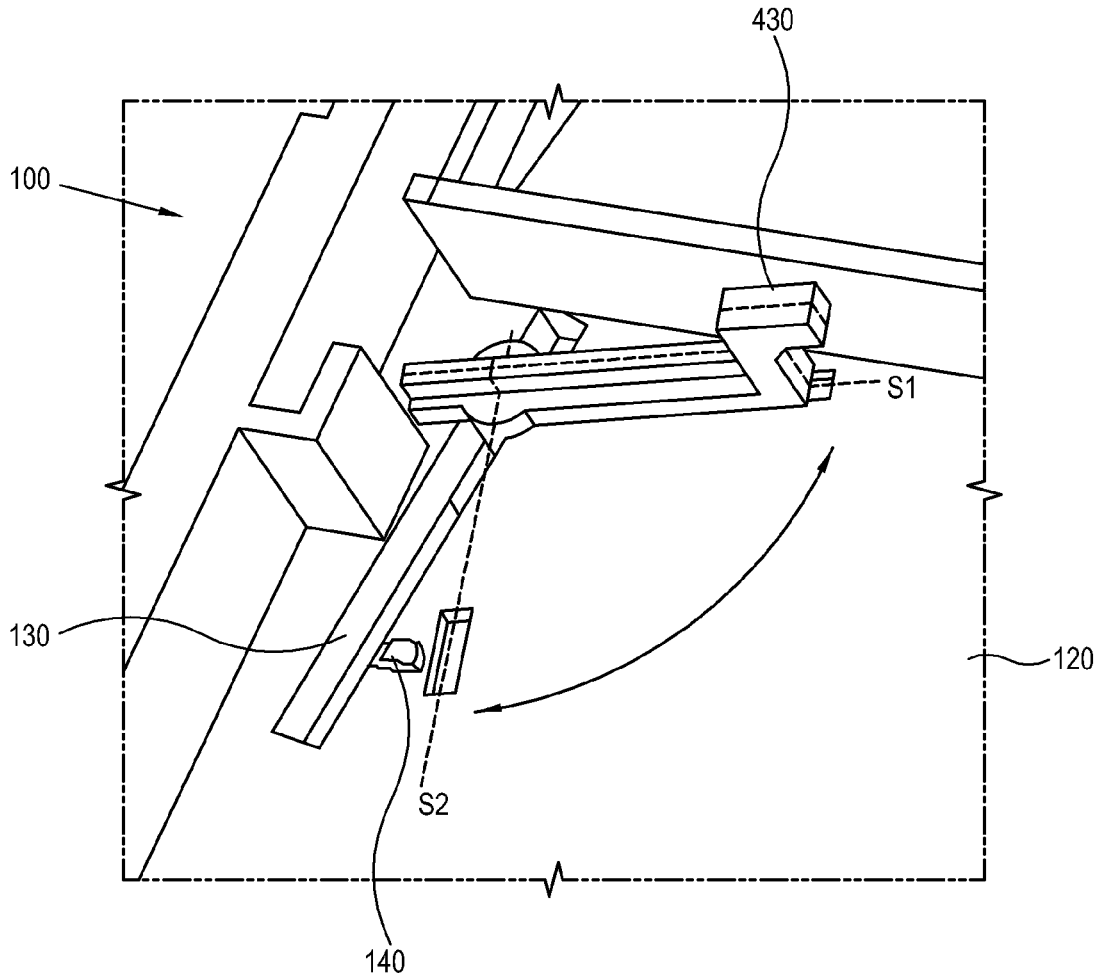
FIG. 2 is a perspective rear view of a main portion of the medium feeding unit shown in FIG. 1.

FIG. 1 is a perspective view of a medium feeding unit for use in an image forming apparatus according to an example embodiment of the present invention, and FIG. 2 is a perspective rear view of a main portion of the medium feeding unit shown in FIG. 1.

As shown in FIG. 1 and FIG. 2, a medium feeding unit 10 for use in an image forming apparatus according to an example embodiment of the present invention includes a cassette frame 100 to which a stack of printable media is loaded, a medium guiding unit 300 arranged to guide the printable medium loaded to the cassette frame 100 in a widthwise direction thereof, and a stopper unit 400 arranged to regulate movement of the medium guiding unit 300.

The medium guiding unit 300 includes a pair of guiding members 310 disposed inside the cassette frame 100 to move in a widthwise direction of the printable medium on an upper plane 110 of the cassette frame 100, and to guide the printable medium as the printable medium is being supplied into an image forming apparatus for a printing operation. Here, the widthwise direction of the printable medium refers to a width of opposite sides of a printable medium, that is, a transverse direction to a supply direction of the loaded printable medium.

The stopper unit 400 includes a stopper 410 rotatably disposed inside the cassette frame 100 to regulate movement of the guiding member 310. The stopper 410 is provided so that a position for guiding the movement of the guiding member 310 can vary depending on a rotating position.

The printable medium may have various standards. Among the standards, the width of opposite sides of a standard A4 printable medium is 210 mm, and that of a standard letter printable medium is 215.9 mm. In the present example embodiment, the standard A4 refers to a first standard, and the standard letter refers to a second standard. The position of the stopper 410 for regulating the guiding member 310 may vary to correspond to the printable medium having these two standard sizes. However, the present invention is not limited thereto.

The cassette frame 100 has a tetragonal planar shape, of which an upper side is open, and is detachably provided to a main body frame (not shown) of an image forming apparatus. Accordingly, a stack of printable media can be loaded to the cassette frame 100.

The cassette frame 100 includes an upper plane 110 on which the printable medium is loaded, and a lower plane 120 forming a rear surface of the upper plane 110.

The printable medium is loaded on a central area of the upper plane 110, and a loading plate 200 is disposed to a side of a loading area of the printable medium. An end part of the loading plate 200 is rotatably mounted to the cassette frame 100, and an elastic member 210 is interposed between a rear surface of the loading plate 200 and the upper plane 100 to upwardly press a side of the printable medium. Accordingly, if the cassette frame 100 is mounted into the main body of the image forming apparatus, the printable medium can be elevated to have such a height as to allow a pickup roller (not shown) to pick up and supply the printable medium into the image forming apparatus for a printing operation.

A pair of guiding members 310 are disposed to the opposite sides of the printable medium in the widthwise direction. The printable medium is loaded between the pair of the guiding members 310, and the guiding members 310 are provided to move in the widthwise direction of the printable medium, thereby guiding the printable medium to correspond to the standard of the printable medium.

A coupling hole 130 is formed through the upper plane 110 on a moving path of the guiding member 310. The coupling hole 130 is formed through from the upper plane 110 to the lower plane 120 in a position capable of regulating the movement of the guiding member 310 in an area in which no printable medium is loaded.

The coupling hole 130 is also formed such that the stopper unit 400 can be mounted to the cassette frame 100. The coupling hole 130 corresponds to the size and shape of a rotating lever 430 so that the rotating lever 430 can be coupled from the upper plane 110 to protrude from the lower plane 120 of the cassette frame 100.

A separation preventing member 140 is disposed at a distal end of the coupling hole 130 to prevent the rotating lever 430 from rotating to the coupling hole 130 so that the stopper unit 400 can be prevented from being separated from the cassette frame 100 after the rotating lever 430 is supported by a surface of the lower plane 120.

The medium guiding unit 300 includes the pair of guiding members 310, a guiding rail 320 formed to the upper plane 110 to guide the movement of the guiding members 310, and an interlocking gear unit 330 disposed to the cassette frame 100 to interlock the pair of guiding members 310 as the guiding members 310 move in the widthwise direction of the printable medium.

If a user moves one of the guiding members 310 after the printable medium is loaded on the upper plane 110 of the cassette frame 100 between the pair of guiding members 310, the other of the guiding members 310 moves together by means of the interlocking gear unit 330. More specifically, if the left guiding member 310, shown in FIG. 1, is moved rightward in the widthwise direction of the printable medium, the right guiding member 310 moves leftward by means of the interlocking gear unit 330. On the other hand, if the left guiding member 310 is moved leftward, the right guiding member 310 moves rightward in the widthwise direction of the printable medium.

That is, the interval between the pair of guiding members 310 can be appropriately adjusted to correspond to the width of the printable medium by means of the interlocking gear unit 330. As shown in FIG. 1, the interlocking gear unit 330 employs a known gear configuration in which the type and direction of the movement are changed by means of engagement of gear trains. Alternatively, the interlocking gear unit may employ other interlocking configurations that are well-known in the art and, thus, need not be described herein.

Although the stopper unit 400 is applied to one of the pair of the guiding members 310, the movement of the guiding member 310 can be sufficiently regulated by means of the interlocking gear unit 330. Accordingly, in the example embodiment of the present invention, the stopper unit 400 is described to be applied to one of the guiding members 310.

The stopper unit 400 includes the stopper 410, and the rotating lever 430 coupled to a lower side of the stopper 410 so that the stopper 410 can rotate about a rotation shaft 420. In an example embodiment of the present invention, the stopper unit 400 is integrally formed, and is mounted to the cassette frame 100 through the coupling hole 130. However, the configuration of the stopper unit 400 of the present invention is not limited thereto. Alternatively, the stopper 410 and the rotating lever 430 may be coupled to interpose the upper plane 110 and the lower plane 120 therebetween.

Hereinafter, a process of coupling the stopper unit 400 of an integral type to the cassette frame 100 will be described by referring to FIGS. 1 and 2.

The rotating lever 430 faces the upper plane 110, and penetrates from the upper plane 110 to the lower plane 120 through the coupling hole 130 of the cassette frame 100. When a bottom surface of the stopper 410 contacts to the upper plane 110, the rotating lever 430 penetrates through the coupling hole 130 to protrude from the lower plane 120.

Then, an end part of the rotating lever 430 protruding from the lower plane 120 is held and drawn to be rotated to pass by the separation preventing member 140. If the rotating lever 430 passes by the separation preventing member 140, the external force is withdrawn. The rotating lever 430 is supported to the lower plane 120 so that the stopper unit 400 can be coupled to the cassette frame 100. Also, although the rotating lever 430 rotates along a surface of the lower plane 120 of the cassette frame 100, the rotating position thereof is prevented from reaching the coupling hole 130 by means of the separation preventing member 140. Accordingly, the stopper unit 400 can be secured to the cassette frame 100 and can be prevented from being separated from the cassette frame 100.

Hereinafter, a process of handling the stopper 410 to correspond to the case that printable media of the first standard and the second standard are respectively loaded will be described by referring to FIGS. 2 to 4.

Figure 3:
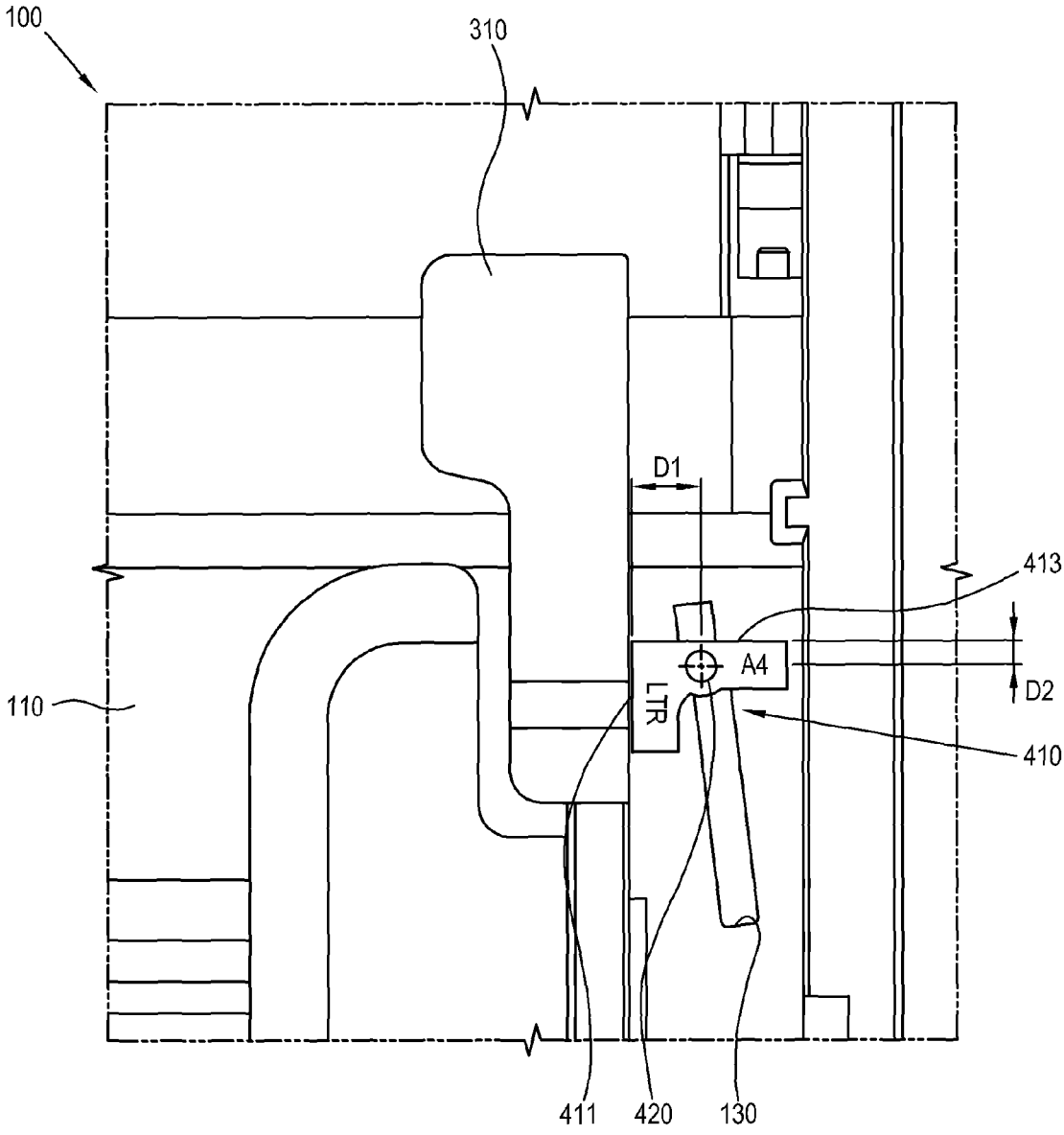
FIG. 3 is a plane view of a main portion of the medium feeding unit shown in FIG. 1 in which a stopper regulates a guiding member to correspond to a printable medium of a first standard size.
Figure 4:
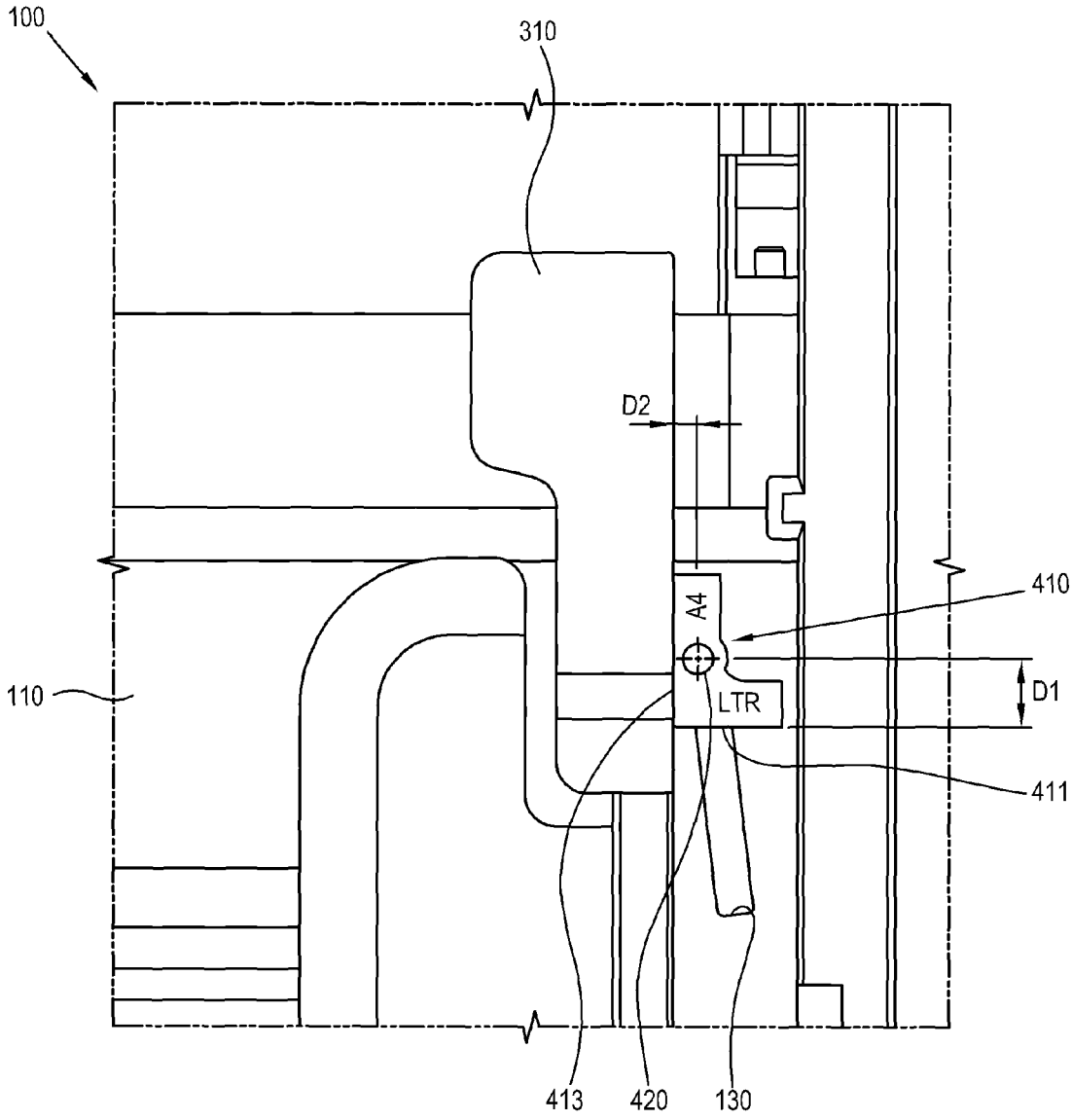
FIG. 4 is a plane view of a main portion of the medium feeding unit shown in FIG. 1 in which a stopper regulates a guiding member to correspond to a printable medium of a second standard size.

FIG. 3 is a plane view of a main portion of the medium feeding unit shown in FIG. 1 in which a stopper 410 is rotated to regulate a guiding member 310 to correspond to a printable medium having the first standard, and FIG. 4 is a plane view of the main portion of the medium feeding unit shown in FIG. 1 in which a stopper 410 is rotated to regulate a guiding member 310 to correspond to a printable medium having the second standard.

As shown in FIGS. 3 and 4, an end part of the stopper 410 formed in a radius direction of the rotation shaft 420 with respect to the rotation shaft 420 contacts to the guiding member 310 to regulate the movement of the guiding member 310. Here, the stopper 410 rotates about the rotation shaft 420 so that the end part of the stopper 410 contacting to the guiding member 310 can be changed, and the stopper 410 and the guiding member 310 surface-contact to each other, thereby preventing the stopper 410 from arbitrarily rotating, and regulating the movement of the guiding member 310.

The stopper 410 is formed with a plurality of regulating portions contacting to the guiding member 310 to regulate the movement thereof. In an example embodiment of the present invention, the stopper 410 has a first regulating portion 411 at one end to correspond to the printable medium of the first, and a second regulating portion 413 at an opposite end to correspond to the printable medium of the second standard.

As the stopper 410 rotates, the first regulating portion 411 and the second regulating portion 413 may selectively regulate the guiding member 310.

Here, D1 refers to the shortest distance from the rotation shaft 420 to the first regulating portion 411, and D2 refers to the shortest distance from the rotation shaft 420 to the second regulating portion 413. The two distances. D1 and D2, are different. Here, if the first standard is the standard letter, and the second standard is the standard A4, the width of the printable medium of the first standard is 215.9 mm, and the width of the printable medium of the second standard is 210 mm. Accordingly, since the width of the printable medium of the first standard is bigger than that of the printable medium of the second standard. D1 is bigger than D2.

With this configuration, in case of loading the printable medium of the first standard, a handling method of the stopper 410 can be described as follows. Referring to FIG. 2, a user rotates the rotating lever 430 at the lower plane 120 of the cassette frame 100 to a first rotation position S1. Accordingly, as shown in FIG. 3, the stopper 410 rotates to a position in which the first regulating portion 411 of the stopper 410 regulates the guiding member 310 to secure the printable medium of the first standard, i.e., the standard letter size.

Referring to FIG. 3, the printable medium (not shown) is loaded in a left side of the guiding member 310, and movement of a right side of the guiding member 310 is regulated by means of the stopper 410.

Referring back to FIG. 2, in case of loading the printable medium of the second standard, the user rotates the rotating lever 430 at the lower plane 120 of the cassette frame 100 to a second rotation position S2. Then, as shown in FIG. 4, the stopper 410 interlocks thereto to rotate to a position in which the second regulating portion 413 of the stopper 410 regulates the guiding member 310 to secure the printable medium of the second standard, i.e., the standard A4 size.

Here, the first rotation position S1 and the second rotation position S2 are different and are rotation positions about the rotation shaft 420, and there is no specific limit as long as the rotating lever 430 rotates the stopper 410 so that the first regulating portion 411 and the second regulating portion 413 can selectively regulate the guiding member 310.

Referring to FIG. 3, if the first regulating portion 411 of the stopper 410 regulates the guiding member 310, the distance from the rotation shaft 420 to the guiding member 310 becomes D1. On the other hand, referring to FIG. 4, if the second regulating portion 413 of the stopper 410 regulates the guiding member 310, the distance from the rotation shaft 420 to the guiding member 310 becomes D2.

That is, if regulating of the guiding member 310 is converted from the first regulating portion 411 to the second regulating portion 413, the guiding member 310 becomes movable by difference between D1 and D2. Accordingly, the guiding member 310 can move to a position guiding the printable medium of the second standard.

As described above, the guiding member 310 can move to correspond to the standard of the printable medium, and the stopper 410 can rotate to change the position thereof regulating the guiding member 310. Accordingly, the guiding member 310 can be appropriately regulated to correspond to a variation in the standard of the loaded printable medium.

A recognizing mark to inform the user which of the first standard and the second standard a rotation state of the stopper 410 corresponds to may be provided to an upper side of the stopper 410.

For example, as shown in FIG. 3, if the rotation state of the stopper 410 corresponds to the printable medium of the first standard, the recognizing mark is provided so that the recognizing mark representing the first standard can be correctly viewed by the user. Also, as shown in FIG. 4, if the rotation state of the stopper 410 corresponds to the printable medium of the second standard, the recognizing mark is provided so that the recognizing mark representing the second standard can be correctly viewed by the user. Accordingly, the user can easily discern the rotation state of the stopper 410.

In an example embodiment of the present invention, the stopper 410 is provided to correspond to the printable medium of the two standards. However, the present invention is not limited thereto. For example, the stopper 410 may have a polygonal configuration having three or more regulating portions, and have an eccentric rotation shaft so that all distances from the rotation shaft to the respective regulating portions can be different.

Also, the user rotates the rotating lever 430 to rotate the stopper 410. However, the rotating method of the stopper 410 is not limited thereto. For example, the stopper 410 including a handle provided to an upper side thereof may be rotatably coupled to the upper plane 110.

Figure 5:
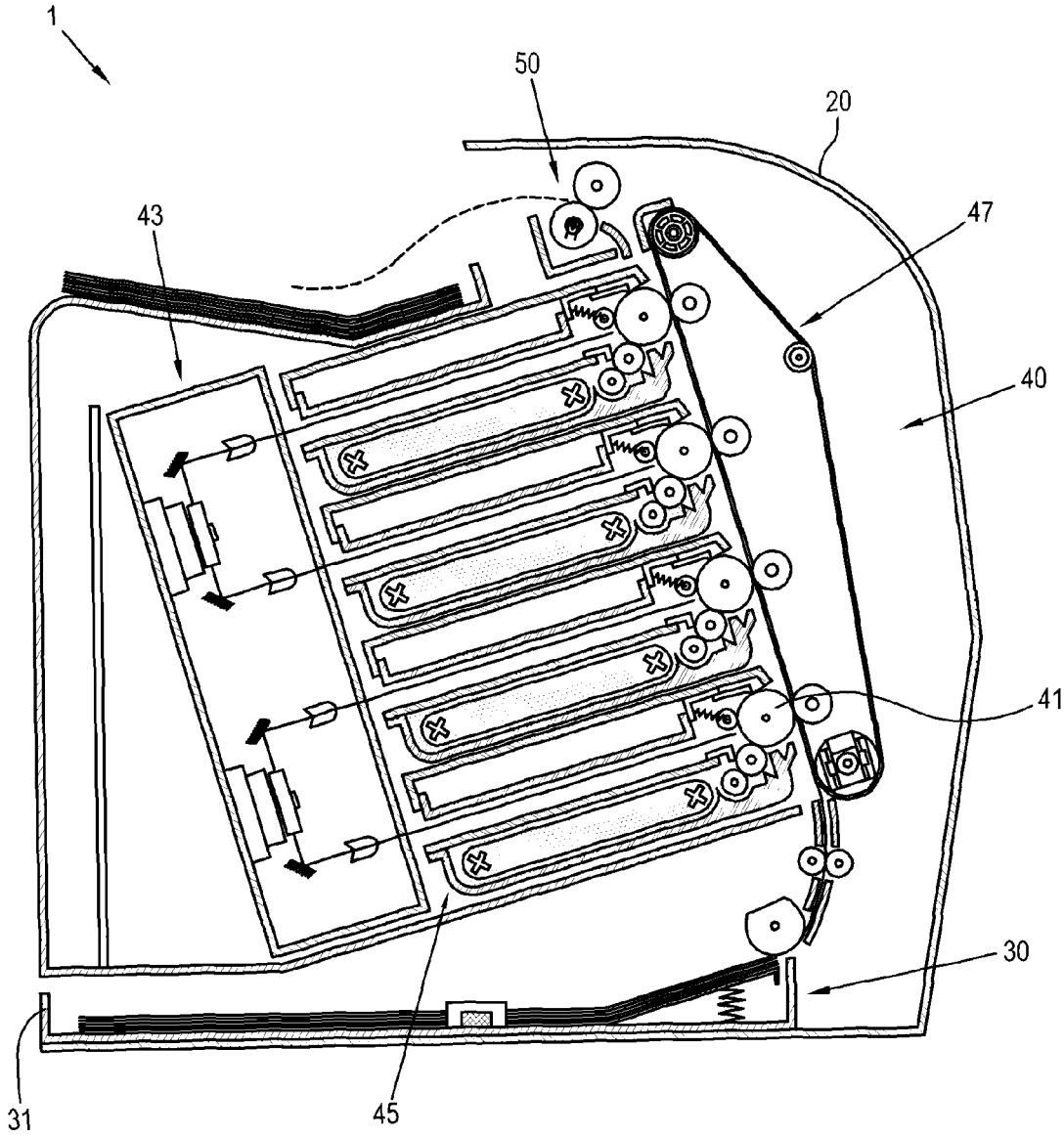
FIG. 5 is a sectional side view of an image forming apparatus according to an example embodiment of the present invention.

FIG. 5 is a sectional view of an image forming apparatus 1 according to an example embodiment of the present invention. As shown in FIG. 5, the image forming apparatus 1 includes a main body frame 20, a medium feeding unit 30 for loading and supplying a printable medium, and an image forming unit 40 for forming an image on the printable medium supplied from the medium feeding unit 30.

The image forming unit 40 includes a plurality of image carrying bodies 41 on which a visible image is formed by means of an electrostatic latent image and a developer, a light scanning unit 43 for forming the electrostatic latent image on the image carrying bodies 41, a developing unit 45 for supplying the developer to the image carrying bodies 41, and a transferring unit 47 for transferring the visible image of the image carrying bodies 41 to the printable medium. Also, a fusing unit 50 is further provided to apply heat and pressure to the printable medium to which the visible image is transferred, thereby fusing the visible image on the printable medium. However, the configuration of the image forming unit 40 is not limited thereto; rather, various known image forming configurations may be applied thereto.

In an example embodiment of the present invention, the image forming unit 40 transfers the visible image by means of the developer on the printable medium. However, the present invention is not limited thereto. For example, the image forming unit 40 may be provided to eject an ink on a printable medium to form an image.

The printable medium is loaded to the medium feeding unit 30, and the medium feeding unit 30 supplies the loaded printable medium to the image forming unit 40 one by one. A cassette frame 31 to which the printing medium is loaded is capable of being detachably mounted to the main body frame 20 so that the user can easily load the printable medium to the medium feeding unit 30. The medium feeding unit 30 may have the same configuration as the medium feeding unit 10 according to an example embodiment of the present invention.

The image carrying body 41 is provided in plural to form a color image on the printing medium. For example, four bodies corresponding to yellow, magenta, cyan and black are disposed in order along a transport path of the printing medium. After an outer surface of the image carrying body 41 is uniformly charged, a potential difference is generated by means of a beam from the light scanning unit 43 to form the electrostatic latent image. If the developer is supplied from the developing unit 45 to the image carrying body 41 formed with the electrostatic latent image, the visible image is formed on the image carrying body 41 by means of the developer.

The light scanning unit 43 scans the beam to form the electrostatic latent image on each image carrying body 41. The light scanning unit 43 divides image information of the color image to be finally formed by each color, and forms the electrostatic latent image on each image carrying body 41 based thereon.

The developing unit 45 is provided to correspond to the plurality of image carrying bodies 41 provided by each developer color. Accordingly, the visible image having a different color is formed on each image carrying body 41.

The transferring unit 47 transports the printable medium to pass through the plurality of image carrying bodies 41, and overlappingly transfers the visible image of each image carrying body 41 on the printable medium.

According to an example embodiment of the present invention, a stopper including a guiding member having a varying supporting position is employed to regulate the guiding member to correspond to a standard of a printing medium. Accordingly, a loaded printing medium can be prevented from moving right and left, thereby preventing inferiority of an image. Also, this can be achieved to correspond to variation of the standard of the printable medium. Accordingly, reliability of a product can be improved.

Also, the stopper is rotated by means of a simple handling to change the position thereof regulating the guiding member, thereby appropriately corresponding to the standard of the loaded printable medium. Accordingly, convenience of a user can be improved.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, printable media having different standard sizes from standard A4 size and standard letter size can also be utilized, such as, large size, executive size, JIS size, B5 size and A5 size. In addition, an extra guiding member can also be arranged to slide along a supplying direction of a printable medium so as to accommodate the printable medium of different sizes and different lengths. Accordingly, it is intended, therefore, that the present invention not be limited to the various example embodiments disclosed, but that the present invention includes all embodiments falling within the scope of the appended claims.

What is claimed is:

1. A medium feeding unit of an image forming apparatus, comprising:

a cassette frame having an upper plane to load a printable medium;

a guiding member disposed on the upper plane and inside the cassette frame to move in a widthwise direction of the printable medium, and to guide the printable medium; and a stopper on the upper plane and inside the cassette frame to regulate movement of the guiding member so as to accommodate the printable medium of different standards and prevent a gap from occurring between the guiding member and the printable medium of the different standards, wherein the stopper comprises a plurality of regulating portions extending in different directions which are capable of contacting the guiding member, and distances from a rotation center of the stopper to the regulating portions are different from each other.

2. A medium feeding unit of an image forming apparatus, comprising:

a cassette frame having an upper plane to load a printable medium;

a guiding member disposed on the upper plane and inside the cassette frame to move in a widthwise direction of the printable medium, and to guide the printable medium; and a stopper rotatably disposed on the upper plane and inside the cassette frame to regulate movement of the guiding member so as to accommodate the printable medium of different standards and prevent a gap from occurring between the guiding member and the printable medium of the different standards;

wherein:

the stopper comprises a plurality of regulating portions which are capable of contacting the guiding member, and distances from a rotation center of the stopper to the regulating portions are different from each other;

the guiding member moves to correspond to the printable medium of a first standard or a second standard different from the first standard; and the plurality of regulating portions comprise:

a first regulating portion which regulates the movement of the guiding member if the printable medium of the first standard is loaded; and a second regulating portion which regulates the movement of the guiding member if the printable medium of the second standard is loaded.

3. The medium feeding unit according to claim 2, wherein the printable medium of the first standard is an A4 standard printable medium, and the printable medium of the second standard is a letter standard printable medium.

4. The medium feeding unit according to claim 3, further comprising a rotating lever which is coupled to the stopper and extends through the upper plane of the cassette frame to rotate the stopper so as to regulate the movement of the guiding member.

5. The medium feeding unit according to claim 4, further comprising:

a coupling hole perforated through the upper plane of the cassette frame to enable the rotating lever to couple to the cassette frame, and to rotate the stopper; and a separation preventing member formed on the cassette frame to prevent the rotating lever from being separated from the cassette frame.

6. The medium feeding unit according to claim 1, further comprising a rotating lever which is coupled to the stopper and extends through the upper plane of the cassette frame to rotate the stopper so as to regulate the movement of the guiding member.

7. The medium feeding unit according to claim 6, further comprising:

a coupling hole perforated through the upper plane of the cassette frame to enable the rotating lever to couple to the cassette frame, and to rotate the stopper; and a separation preventing member formed on the cassette frame to prevent the rotating lever from being separated from the cassette frame.

8. A medium feeding unit of an image forming apparatus, comprising:

a cassette frame having an upper plane to load a printable medium;

a guiding member disposed on the upper plane and inside the cassette frame to move in a widthwise direction of the printable medium, and to guide the printable medium;

a stopper rotatably disposed on the upper plane and inside the cassette frame to regulate movement of the guiding member so as to accommodate the printable medium of different standards and prevent a gap from occurring between the guiding member and the printable medium of the different standards; and a rotating lever which is coupled to the stopper and extends through the upper plane of the cassette frame to rotate the stopper so as to regulate the movement of the guiding member.

9. The medium feeding unit according to claim 8, further comprising:

a coupling hole perforated through the upper plane of the cassette frame to enable the rotating lever to couple to the cassette frame and rotate the stopper; and a separation preventing member formed on the cassette frame to prevent the rotating lever from being separated from the cassette frame.

10. An image forming apparatus, comprising:

an image forming unit which forms an image on a printable medium; and a medium feeding unit which supplies the printable medium to the image forming unit, the medium feeding unit comprising:

a cassette frame having an upper plane to load the printable medium;

a guiding member disposed on the upper plane and inside the cassette frame to move in a widthwise direction of the printable medium, and to guide the printable medium; and a stopper rotatably disposed on the upper plane and inside the cassette frame to regulate movement of the guiding member so as to accommodate the printable medium of different standards, wherein the stopper comprises a plurality of regulating portions extending in different directions which are capable of contacting the guiding member, and distances from a rotation center of the stopper to the regulating portions are different from each other.

11. The image forming apparatus, according to claim 10, further comprising a rotating lever which is coupled to the stopper and extends through the upper plane of the cassette frame to rotate the stopper so as to regulate the movement of the guiding member.

12. The image forming apparatus according to claim 11, wherein the medium feeding unit further comprises:

a coupling hole perforated through the upper plane of the cassette frame to enable the rotating lever to couple to the cassette frame, and to rotate the stopper; and a separation preventing member formed on the cassette frame to prevent the rotating lever from being separated from the cassette frame.

13. An image forming apparatus, comprising:

an image forming unit which forms an image on a printable medium; and a medium feeding unit which supplies the printable medium to the image forming unit, the medium feeding unit comprising:

a cassette frame having an upper plane to load the printable medium;

a guiding member disposed on the upper plane and inside the cassette frame to move in a widthwise direction of the printable medium, and to guide the printable medium;

a stopper rotatably disposed on the upper plane and inside the cassette frame to regulate movement of the guiding member so as to accommodate the printable medium of different standards; and a rotating lever which is coupled to the stopper and extends through the upper plane of the cassette frame to rotate the stopper so as to regulate the movement of the guiding member.

14. The image forming apparatus according to claim 13, wherein the medium feeding unit further comprises:

a coupling hole perforated through the upper plane of the cassette frame so that the rotating lever can be coupled to the cassette frame; and a separation preventing member formed on the cassette frame to prevent the rotating lever from being separated from the cassette frame.

15. A medium feeding unit for use in an image forming apparatus, comprising:

a cassette frame having an upper surface to load a printable medium; and a guiding mechanism arranged on the upper surface of the cassette frame to secure and guide the printable medium along a supply direction for an image forming operation;

wherein the guiding mechanism comprises:

a guiding member disposed on the upper surface of the cassette frame to move in a widthwise direction of the printable medium; and a stopper rotatably disposed on the upper surface of the cassette frame to regulate movement of the guiding member so as to accommodate the printable medium of different standard sizes, wherein the stopper comprises:

a rotation shaft;

a first regulating portion extending from a first end of the rotation shaft so as to regulate the movement of the guiding member if the printable medium is a printable medium of a first standard size;

a second regulating portion extending from the first end of the rotation shaft so as to regulate the movement of the guiding member if the printable medium is a printable medium of a second standard size; and a rotating lever extending from a second end of the rotation shaft through the upper surface of the cassette frame so as to enable a user to rotate the stopper to regulate the movement of the guiding member.

16. The medium feeding unit according to claim 15, further comprising:

a coupling hole perforated through the upper surface of the cassette frame to enable the rotating lever to couple to the cassette frame, and to rotate the stopper; and a separation preventing member formed on the cassette frame to prevent the rotating lever from being separated from the cassette frame.

17. A medium feeding unit for use in an image forming apparatus, comprising:

a cassette frame having an upper surface to load a printable medium; and a guiding mechanism arranged on the upper surface of the cassette frame to secure and guide the printable medium along a supply direction for an image forming operation;

wherein the guiding mechanism comprises:

a guiding member disposed on the upper surface of the cassette frame to move in a widthwise direction of the printable medium; and a stopper rotatably disposed on the upper surface of the cassette frame to regulate movement of the guiding member so as to accommodate the printable medium of different standard sizes, wherein the stopper has an L-shaped structure comprising:

a rotation shaft;

a first end extending from the rotation shaft;

a second end extending from the rotation shaft; and a rotating lever extending from the rotation shaft through the upper surface of the cassette frame so as to enable a user to rotate the first end and the second end to regulate the guiding member between a first rotation position to accommodate the printable medium of a first standard size and a second rotation position to accommodate the printable medium of a second standard size.

* * * * *